US008480499B2

(12) United States Patent
Herrmann

(10) Patent No.: US 8,480,499 B2
(45) Date of Patent: Jul. 9, 2013

(54) SYSTEM AND METHOD FOR GAME BROKERING

(75) Inventor: Mark E. Herrmann, Wellesley, MA (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 901 days.

(21) Appl. No.: 12/433,556

(22) Filed: Apr. 30, 2009

(65) Prior Publication Data

US 2009/0291750 A1 Nov. 26, 2009

Related U.S. Application Data

(60) Provisional application No. 61/049,325, filed on Apr. 30, 2008.

(51) Int. Cl.
*A63F 9/24* (2006.01)

(52) U.S. Cl.
USPC ..... 463/43; 463/25; 463/29; 463/42

(58) Field of Classification Search
None
See application file for complete search history.

(56) References Cited

U.S. PATENT DOCUMENTS

| | | | | |
|---|---|---|---|---|
| 5,894,556 | A | 4/1999 | Grimm et al. | |
| 6,023,729 | A | 2/2000 | Samuel et al. | |
| 6,604,997 | B2 | 8/2003 | Saidakovsky et al. | |
| 6,641,481 | B1 | 11/2003 | Mai et al. | |
| 7,029,394 | B2 | 4/2006 | Leen et al. | |
| 7,614,944 | B1 * | 11/2009 | Hughes et al. | 463/4 |
| 2007/0060328 | A1 | 3/2007 | Zrike et al. | |
| 2007/0173325 | A1 | 7/2007 | Shaw et al. | |
| 2009/0029766 | A1 * | 1/2009 | Lutnick et al. | 463/29 |

OTHER PUBLICATIONS

LeagueLSSafe, 1pages printed from https://www.leaguesafe.com/home.aspx, printed on Feb. 4, 2011.
World Winner, 1 page printed from http://web.archive.org/web/20080720062036/http://www.worldwinner.com/, printed on Feb. 4, 2011.
Sports MatchMaker, 2 pages printed from http://web.archive.org/web/20110204205212/http://sportsmatchmaker.com/index.cfm, printed on Feb. 4, 2011.
Daniel Okrent Wikipedia page, 3 pages printed from http://web.archive.org/web/20080801203726/http://en.wikipedia. org/wiki/Daniel_Okrent, printed on Feb. 4, 2011.
CBS Sports, 2 pages printed from http:/www.cbssports.com, printed on Feb. 4, 2011.

* cited by examiner

*Primary Examiner* — Matthew W Such
*Assistant Examiner* — Robert Carpenter
(74) *Attorney, Agent, or Firm* — Dority & Manning, P.A.

(57) ABSTRACT

A method for brokering a game using a computer system is provided. The method includes act of configuring, by the computer system, at least one of a plurality of games to match a set of preferences gathered from a plurality of players, specifying at least one qualification criterion for entry into the at least one of the plurality of games, entering, by the computer system, at least one player having the at least one qualification criterion into the at least one of the plurality of games, receiving, by the computer system, at least one winner of the at least one of the plurality of games, storing information regarding the at least one winner on the data storage, receiving, by the computer system, authorization to reward the at least one winner and providing, to the at least one winner, access to at least one reward.

22 Claims, 7 Drawing Sheets

SYSTEM AND METHOD FOR GAME BROKERING

RELATED APPLICATIONS

This application claims priority under 35 U.S.C. §119(e) to U.S. Provisional Application Ser. No. 61/049,325, entitled "SYSTEM AND METHOD FOR GAME BROKERING," filed on Apr. 30, 2008, which is herein incorporated by reference in its entirety.

BACKGROUND

1. Field of the Invention

The field pertinent to this disclosure relates generally to gaming, and more particularly to brokering games between game players and game providers.

2. Discussion of Related Art

People enjoy playing games and often regard the experience of winning by playing a game to be more valuable than that of the prize itself. Just the chance to win a prize provides considerable entertainment value. Conventional game organizers provide opportunities for such gaming entertainment by organizing and managing games for the game playing community. These game organizers often rely on their own skill, experience and interest to decide upon which games to broker, what the characteristics of the game should be and to which players the game may be of interest. Often, these game organizers draw upon their pre-existing social networks when organizing and managing these games. A particular and interesting example of a frequently brokered game is the fantasy league game.

A fantasy league game (also known as rotisserie, roto, or owner simulation) is a game where fantasy owners build a team that competes against other fantasy team owners based on the statistics generated by individual players or teams of a professional sport or people participating in a real world event. Probably the most common variant converts statistical performance into points that are compiled and totaled according to a roster selected by a team owner that makes up a fantasy team. These point systems are typically simple enough to be manually calculated by a game broker often called a "league commissioner." More complex variants use computer modeling of actual games based on statistical input generated by the real world event. In fantasy sports, for example, there is the ability to trade, cut, and resign players, like a real sports owner. Some of fantasy games require entry fees while others may be played without a fee.

Fantasy league games are an outgrowth of Rotisserie Baseball created by journalist, Daniel Okrent. Okrent, eager to test his invention, introduced the games to his friends and colleagues and in 1980 the first fantasy baseball league was created consisting of ten teams. By the late 1980s, the game had surpassed its cult status, and in 1989, The Sporting News estimated that nearly 500,000 people played. By the early 1990s, rotisserie baseball led to rotisserie football and basketball, which spawned a multitude of other fantasy games.

Today, fantasy sports have evolved to cover almost every sport genre: auto racing, baseball, basketball, bicycle racing, bowling, boxing, cricket, dog racing, fishing, football, golf, gymnastics, hockey, figure skating, volleyball, softball, horse racing, lacrosse, rugby, skiing, soccer, tennis, and even tug of war. These fantasy games are played nationally and internationally by millions of dedicated users. With the success of fantasy sports leagues, other types of fantasy leagues emerged. For example, Fantasy Moguls is like a fantasy baseball or football league, except instead of being the owner of a fantasy team that consists of real life athletes, participants are the head of a fantasy studio of real-life movies.

Although playing fantasy games is a popular activity, a great percentage of the worldwide populations do not play. This is true even after excluding underage persons, those with insufficient disposable income or technical wherewithal and those with a religious or other belief that prevents them from partaking in fantasy league play as recreation.

SUMMARY OF THE INVENTION

One aspect disclosed herein relates to a system for broking various games between game providers and game players. To ensure a variety of games are available to the players, the system may interface with several game providers and automatically configure sundry games to suit various, known player preferences. These player preferences may be gleamed from historical player information. Alternatively, the player preferences may be expressly gathered from the game players, such as through a voting process, either before or after the players have joined a game. Alternatively, the system may support manual game configuration by game organizers, who both enjoy and profit from their activities. The system may enable players to search and join a game so that each player may maximize the entertainment value of the game. The system may restrict access to various games and may allow players with specific qualifications to access the restricted games.

Another aspect disclosed herein manifests a discovery of the need to create a computer implemented method by which fantasy leagues can be easily and efficiently formed by like-minded people who are interested in a certain style of play, format of the league, prize payouts, league fee structure and the league rules. For example, according to one aspect consistent with principles of the present invention, it is appreciated that the general population has difficulty finding fantasy leagues having the characteristics they prefer because fantasy leagues requires either a large group of players to form a league (usually 10 to 20) and that group must agree on the style of play, format of the league, prize payouts, league fee structure and the league rules, or they must play in preformed, brokered leagues (with non-negotiable styles of play, format of the game, prize payouts, league fee structure and the league governing rules). Additionally, those players who are slotted into pre-formed (aka, public leagues) leagues have no choice with whom they compete against. As a result of these factors, most prospective fantasy league players find it either prohibitively difficult to form a fantasy league or to undesirable to join a pre-formed league.

Thus, one example consistent with the principles of the present invention provides a method by which a game brokerage system may facilitate the creation of, or automatically create, a league and, optionally, recruit like-minded, qualified players to join the league while maintaining appropriate safety checks on league governance, rules, entry fee collection, prize awarding and redemption. Another example provides for a system that may enable game fantasy leagues to be formed by fantasy league game organizers (a.k.a., fantasy league commissioners). Alternatively, players may form a league, decide on a particular configuration of rules and other options, and allow the game brokerage system to act as the league commissioner. Game play in the league may have a plurality of outcomes, at least, one of which is a winning outcome. An additional example provides for a method by which qualified league game organizers are able to list their leagues and then search and invite qualified players (a.k.a., qualified team owners) to join and then ultimately play in their league. Yet another example provides a method for serving as an escrow provider separate from being a provider of brokered games. Still another example enables advertisers and other parties to sponsor prizes and other rewards for game players.

In one aspect in accord with the present invention, a method for brokering a game using a computer system is provided. The computer system includes data storage and a processor coupled to the data storage. The method includes act of configuring, by the computer system, at least one of a plurality of games to match a set of preferences gathered from a plurality of players, specifying at least one qualification criterion for entry into the at least one of the plurality of games, entering, by the computer system, at least one player having the at least one qualification criterion into the at least one of the plurality of games, receiving, by the computer system, at least one winner of the at least one of the plurality of games, storing information regarding the at least one winner on the data storage, receiving, by the computer system, authorization to reward the at least one winner and providing, to the at least one winner, access to at least one reward.

In one embodiment, the act of configuring the at least one of the plurality of games may include an act of configuring a fantasy league game. In addition, the act of configuring the at least one of the plurality of games may include an act of defining the set of preferences regarding rules for the at least one of the plurality of games. Moreover, according to one embodiment, the act of configuring the at least one of the plurality of games may include an act of defining the set of preferences regarding entry fee structure for the at least one of the plurality of games. Further, the act of configuring the at least one of the plurality of games may include an act of defining the set of preferences regarding reward payout structure for the at least one of the plurality of games. Additionally, the act of specifying the at least one qualification criterion may include an act of specifying membership in a loyalty club. Furthermore, the act of specifying the at least one qualification criterion may include an act of specifying a value as a gambler.

Continuing in this embodiment, the act of specifying the at least one qualification criterion may include an act of specifying an age requirement. In addition, the act of specifying the at least one qualification criterion may include an act of specifying a minimum income level. Moreover, the act of receiving the authorization to reward the at least one winner may include an act of receiving authorization from a game organizer. Further, the act of receiving the authorization to reward the at least one winner may include an act of receiving authorization from the plurality of players. Additionally, the act of receiving the authorization to reward the at least one winner may include an act of receiving authorization from a combination of a game organizer and the plurality of players.

According to another embodiment, the method may include an act of identifying the plurality of players from a set of potential players, each of the plurality of players having the at least one qualification criterion. In addition, the method may include an act of inviting each of the plurality of players to enter the at least one of the plurality of games. Moreover, the act of specifying the at least one qualification criterion may include an act of specifying a level of skill. Further, the act of specifying a level of skill may include an act of specifying a level of historical performance. Additionally, the method may include an act of receiving prize data describing the at least one reward from at least one sponsor. Furthermore, the method may include an acts of receiving advertisement information from the at least one sponsor and providing the advertisement information to at least one of the plurality of players.

In another embodiment, the method may include an act of receiving prize data describing the at least one reward from any of the plurality of players. In addition, the act of receiving the prize data may include an act of receiving an entry fee and the method further comprises depositing the entry fee into a bank account. Moreover, the act of depositing the entry fee may include an act of depositing the entry fee into an escrow account.

In another aspect in accord with the present invention, a system for brokering games is provided. The system includes a network interface configured to exchange data on a network and a controller coupled to network interface. The controller is configured to generate configuration data for transmission via the network interface to at least one of the plurality of game systems, the configuration data indicating at least one of a plurality of games and being based at least in part on a set of preferences of a plurality of players, generate entry data for transmission via the network interface to the at least one of the plurality of game systems, the entry data indicating at least one player from the plurality of players and indicating the at least one of the plurality of games, parse outcome data received via the network interface from the at least one of the plurality of game systems, the outcome data indicating at least one winner of the at least one of the plurality of games, parse authorization data received via the network interface and generate reward data for transmission via the network interface to the at least one reward entity, the reward data indicating at least one reward and the at least one winner.

In one embodiment, the at least one of the plurality of games may include a fantasy league game. In addition, the set of preferences may indicate a set of rules for the at least one of the plurality of games. Moreover, the set of preferences may indicate an entry fee structure for the at least one of the plurality of games. Further, the set of preferences may indicate a reward payout structure for the at least one of the plurality of games. Additionally, the system may include a user interface to which the controller is coupled and the controller may be further configured to parse authorization data received via the user interface from the plurality of players. Furthermore, the controller may be further configured to parse authorization data received via the user interface from a combination of a game broker and the plurality of players.

In another embodiment, the controller may be further configured to transmit an invitation via the network interface to each of the plurality of players, the invitation indicating the at least one of the plurality of games. In addition, the controller may be further configured to parse authorization data received via the user interface from a game organizer. Moreover, the controller may be further configured to parse prize data received via the network interface, the reward data indicating at least one reward. Further, the prize data may indicate at least one sponsor who will provide the at least one reward and the controller may be further configured to parse advertisement information received via the network interface from the at least one sponsor and transmit the advertisement information via the network interface to at least one of the plurality of players. Additionally, the prize data may indicate at least one of the plurality of players who will provide the at least one reward. Furthermore, the prize data may include an entry fee and the controller may be further configured to generate deposit data for transmission via the network interface to a financial institution, the deposit data indicating a bank account. Still further, the controller may be further configured to generate deposit data for transmission via the network interface to a financial institution, the deposit data indicating an escrow account.

In another embodiment, the controller may be further configured to parse player data received via the network interface from at least one of the plurality of player information systems, the player data indentifying the plurality of players. In addition, the controller may be further configured to generate qualification data for transmission via the network interface to the at least one of the plurality of player information systems, the qualification data indicating at least one criterion for entry into the at least one of the plurality of games. Moreover, the at least one criterion may indicate that each of the plurality of players should be a member of a loyalty club. Further, the at least one criterion may indicate that each of the plurality of players should have a specified level of skill. Additionally, the at least one criterion may indicate that each of the plurality of players should have a specified value as a gambler. Furthermore, the at least one criterion may indicate that each of the plurality of players should be older than a specified age. Further still, the at least one criterion may indicate that each of the plurality of players should have an income greater than a specified level.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
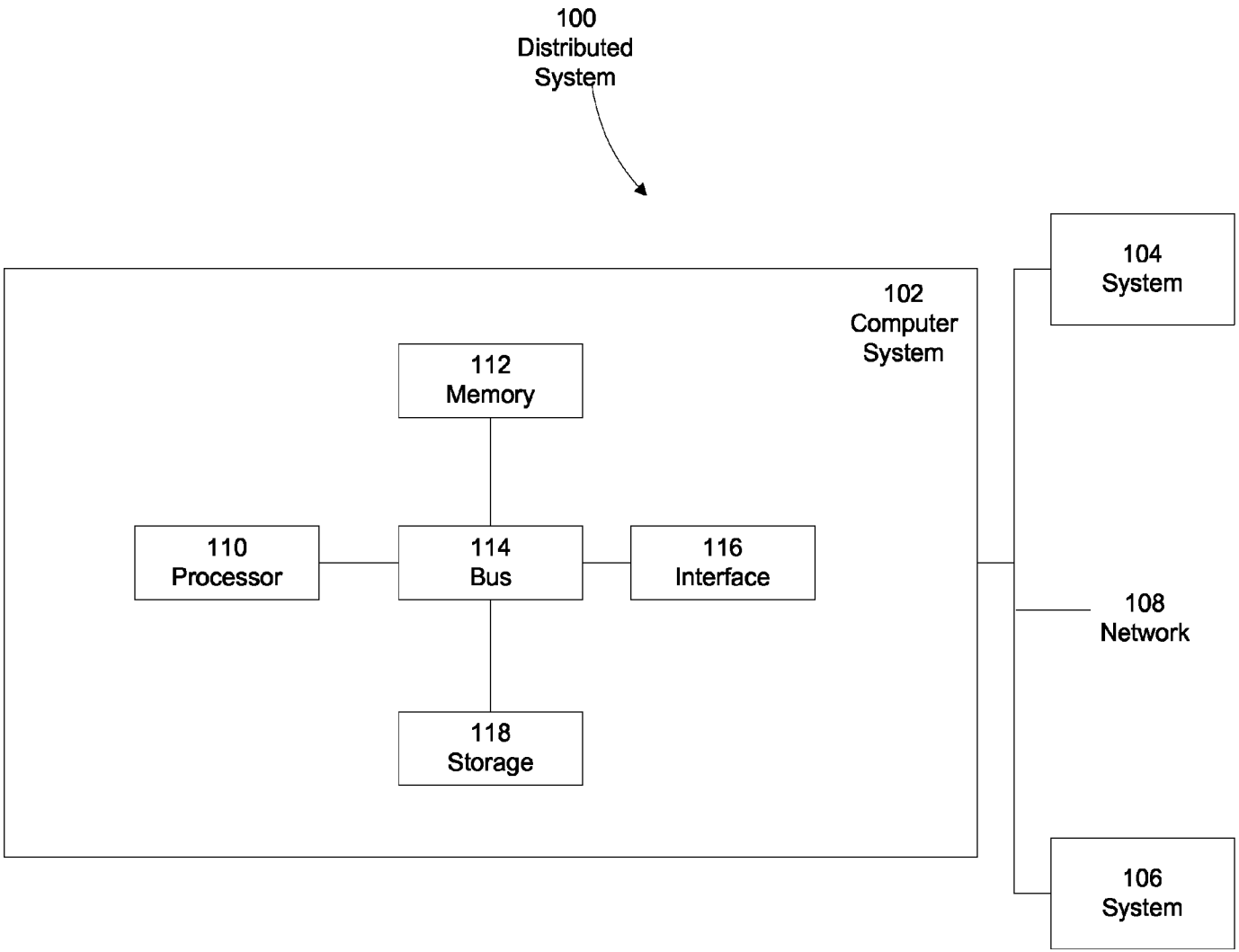
FIG. 1 shows an example computer system with which various aspects in accord with the present invention may be implemented.

At least some examples in accord with the present invention relate to systems and processes for brokering games administered by game providers to game players using a distributed computer system. In one example, the game broker identifies characteristics of games that are popular among a targeted set of players. The game broker may then configure games as necessary to include the identified characteristics and provide players with notice of the existent of the game.

The aspects disclosed herein, which are in accord with the present invention, are not limited in their application to the details of construction and the arrangement of components set forth in the following description or illustrated in the drawings. These aspects are capable of assuming other examples and of being practiced or of being carried out in various ways. Examples of specific implementations are provided herein for illustrative purposes only and are not intended to be limiting. In particular, acts, elements and features discussed in connection with any one or more examples are not intended to be excluded from a similar role in any other example.

For instance, according to one example, a computer system is configured to perform any of the functions described herein, including but not limited to, configuring the characteristics of a game. However, such a system may also perform other functions such as presenting a user interface to allow a game broker to quality a set of players. Moreover, the systems described herein may be configured to include or exclude any of the functions discussed herein. Thus the invention is not limited to a specific function or set of functions. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items.

Computer System

Various aspects and functions described herein in accord with the present invention may be implemented as hardware or software on one or more computer systems. There are many examples of computer systems currently in use. These examples include, among others, network appliances, personal computers, workstations, mainframes, networked clients, servers, media servers, application servers, database servers and web servers. Other examples of computer systems may include mobile computing devices, such as cellular phones and personal digital assistants, and network equipment, such as load balancers, routers and switches. Further, aspects in accord with the present invention may be located on a single computer system or may be distributed among a plurality of computer systems connected to one or more communications networks.

For example, various aspects and functions may be distributed among one or more computer systems configured to provide a service to one or more client computers, or to perform an overall task as part of a distributed system. Additionally, aspects may be performed on a client-server or multi-tier system that includes components distributed among one or more server systems that perform various functions. Consequently, the invention is not limited to executing on any particular system or group of systems. Further, aspects may be implemented in software, hardware or firmware, or any combination thereof. Thus, aspects in accord with the present invention may be implemented within methods, acts, systems, system elements and components using a variety of hardware and software configurations, and the invention is not limited to any particular distributed architecture, network, or communication protocol.

FIG. 1 shows a block diagram of a distributed computer system 100, in which various aspects and functions in accord with the present invention may be practiced. Distributed computer system 100 may include one more computer systems. For example, as illustrated, distributed computer system 100 includes computer systems 102, 104 and 106. As shown, computer systems 102, 104 and 106 are interconnected by, and may exchange (receive or provide) data through, communication network 108. Network 108 may include any communication network through which computer systems and NCPI devices may exchange data. To exchange data using network 108, computer systems 102, 104 and 106 and network 108 may use various methods, protocols and standards, including, among others, token ring, ethernet, wireless ethernet, Bluetooth, TCP/IP, UDP, HTTP, FTP, SNMP, SMS, MMS, SS7, JSON, SOAP, CORBA, REST and Web Services. To ensure data transfer is secure, computer systems 102, 104 and 106 may transmit data via network 108 using a variety of security measures including TSL, SSL or VPN, among other security techniques. While distributed computer system 100 illustrates three networked computer systems, distributed computer system 100 may include any number of computer systems and computing devices, networked using any medium and communication protocol.

Various aspects and functions in accord with the present invention may be implemented as specialized hardware or software executing in one or more computer systems including computer system 102 shown in FIG. 1. As depicted, computer system 102 includes processor 110, memory 112, bus 114, interface 116 and storage 118. Processor 110 may perform a series of instructions that result in manipulated data. Processor 110 may be a commercially available processor such as an Intel Xeon, Itanium, Core, Celeron, Pentium, AMD Opteron, Sun UltraSPARC, IBM Power5+, or IBM mainframe chip, but may be any type of processor, multiprocessor or controller. Processor 110 is connected to other system elements, including one or more memory devices 112, by bus 114.

Memory 112 may be used for storing programs and data during operation of computer system 102. Thus, memory 112 may be a relatively high performance, volatile, random access memory such as a dynamic random access memory (DRAM) or static memory (SRAM). However, memory 112 may include any device for storing data, such as a disk drive or other non-volatile storage device. Various examples in accord with the present invention may organize memory 112 into particularized and, in some cases, unique structures to perform the aspects and functions disclosed herein.

Components of computer system 102 may be coupled by an interconnection element such as bus 114. Bus 114 may include one or more physical busses, for example, busses between components that are integrated within a same machine, but may include any communication coupling between system elements including specialized or standard computing bus technologies such as IDE, SCSI, PCI and InfiniBand. Thus, bus 114 enables communications, for example, data and instructions, to be exchanged between system components of computer system 102.

Computer system 102 also includes one or more interface devices 116 such as input devices, output devices and combination input/output devices. Interface devices may receive input or provide output. More particularly, output devices may render information for external presentation. Input devices may accept information from external sources. Examples of interface devices include keyboards, mouse devices, trackballs, microphones, touch screens, printing devices, display screens, speakers, network interface cards, etc. Interface devices allow computer system 102 to exchange information and communicate with external entities, such as users and other systems.

Storage system 118 may include a computer readable and writeable nonvolatile data storage medium in which instructions are stored that define a program to be executed by the processor. Storage system 118 also may include information that is recorded, on or in, the medium, and this information may be processed by the program. More specifically, the information may be stored in one or more data structures specifically configured to conserve storage space or increase data exchange performance. The instructions may be persistently stored as encoded signals, and the instructions may cause a processor to perform any of the functions described herein. The medium may, for example, be optical disk, magnetic disk or flash memory, among others. In operation, the processor or some other controller may cause data to be read from the nonvolatile recording medium into another memory, such as memory 112, that allows for faster access to the information by the processor than does the storage medium included in storage system 118. The memory may be located in storage system 118 or in memory 112, however, processor 110 may manipulate the data within the memory 112, and then copy the data to the medium associated with storage system 118 after processing is completed. A variety of components may manage data movement between the medium and integrated circuit memory element and the invention is not limited thereto. Further, the invention is not limited to a particular memory system or storage system.

Although computer system 102 is shown by way of example as one type of computer system upon which various aspects and functions in accord with the present invention may be practiced, aspects of the invention are not limited to being implemented on the computer system as shown in FIG. 1. Various aspects and functions in accord with the present invention may be practiced on one or more computers having a different architectures or components than that shown in FIG. 1. For instance, computer system 102 may include specially-programmed, special-purpose hardware, such as for example, an application-specific integrated circuit (ASIC) tailored to perform a particular operation disclosed herein. While another example may perform the same function using several general-purpose computing devices running MAC OS System X with Motorola PowerPC processors and several specialized computing devices running proprietary hardware and operating systems.

Computer system 102 may be a computer system including an operating system that manages at least a portion of the hardware elements included in computer system 102. Usually, a processor or controller, such as processor 110, executes an operating system which may be, for example, a Windows-based operating system, such as, Windows NT, Windows 2000 (Windows ME), Windows XP or Windows Vista operating systems, available from the Microsoft Corporation, a MAC OS System X operating system available from Apple Computer, one of many Linux-based operating system distributions, for example, the Enterprise Linux operating system available from Red Hat Inc., a Solaris operating system available from Sun Microsystems, or a UNIX operating systems available from various sources. Many other operating systems may be used, and examples are not limited to any particular implementation.

The processor and operating system together define a computer platform for which application programs in high-level programming languages may be written. These component applications may be executable, intermediate, bytecode or interpreted code which communicates over a communication network, for example, the Internet, using a communication protocol, for example, TCP/IP. Similarly, aspects in accord with the present invention may be implemented using an object-oriented programming language, such as .Net, SmallTalk, Java, C++, Ada, or C# (C-Sharp). Other object-oriented programming languages may also be used. Alternatively, functional, scripting, or logical programming languages may be used.

Additionally, various aspects and functions in accord with the present invention may be implemented in a non-programmed environment, for example, documents created in HTML, XML or other format that, when viewed in a window of a browser program, render aspects of a graphical-user interface or perform other functions. Further, various examples in accord with the present invention may be implemented as programmed or non-programmed elements, or any combination thereof. For example, a web page may be implemented using HTML while a data object called from within the web page may be written in C++. Thus, the invention is not limited to a specific programming language and any suitable programming language could be used.

Examples in accord with the present invention may perform functions outside the scope of the invention. For instance, aspects of the system may be implemented using an existing commercial product, such as, for example, Database Management Systems such as SQL Server available from Microsoft of Seattle Wash., Oracle Database from Oracle of Redwood Shores, Calif., and MySQL from Sun Microsystems of Santa Clara, Calif. or integration software such as Web Sphere middleware from IBM of Armonk, N.Y. However, a computer system running, for example, SQL Server may be able to support both aspects in accord with the present invention and databases for sundry applications not within the scope of the invention.

The Game Broker

Figure 2:
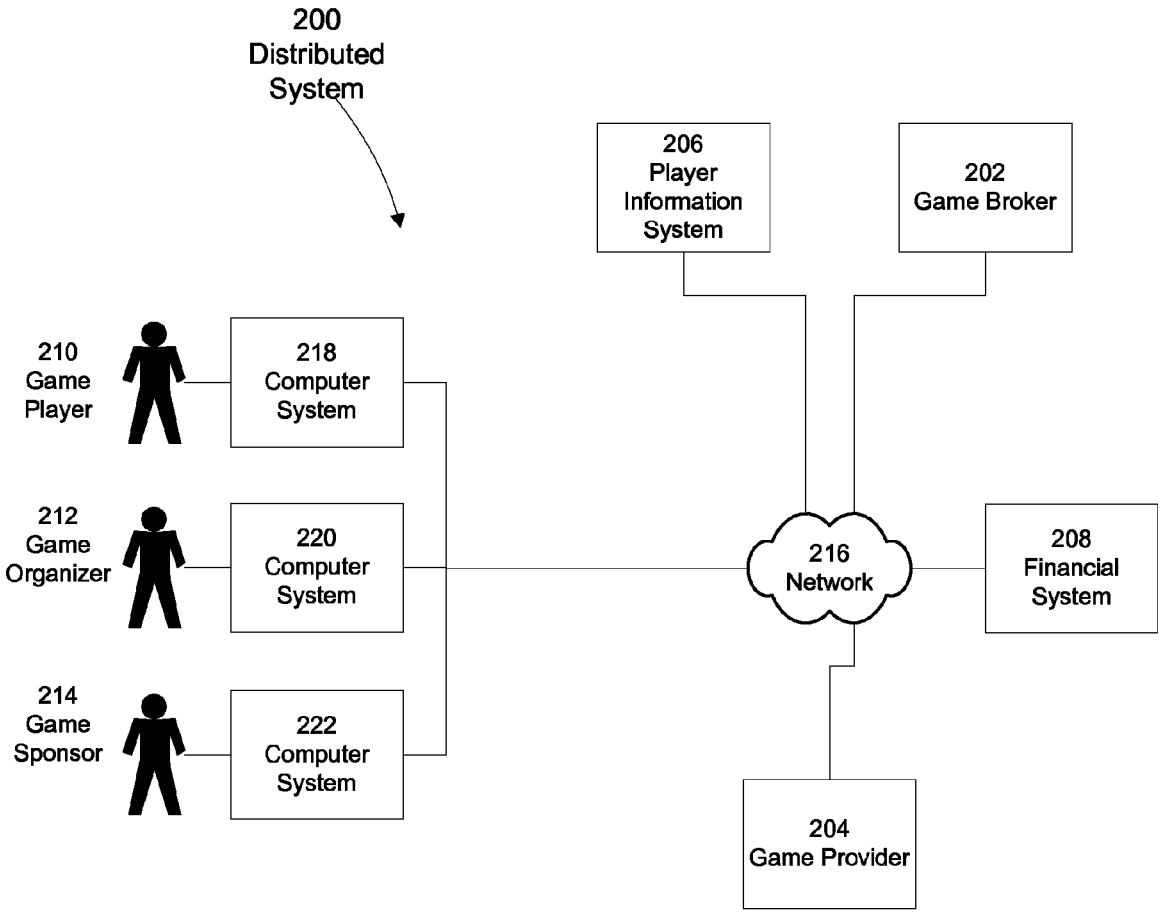
FIG. 2 illustrates an example distributed system in accord with the present invention.

FIG. 2 presents a context diagram including physical and logical elements of distributed system 200. As shown, distributed system 200 is specially configured in accord of the present invention. The system structure and content recited with regard to FIG. 2 is for exemplary purposes only and is not intended to limit the invention to the specific structure shown in FIG. 2. As will be apparent to one of ordinary skill in the art, many variant system structures can be architected without deviating from the scope of the present invention. The particular arrangement presented in FIG. 2 was chosen to promote clarity.

Referring to FIG. 2, a system 200 includes a game broker 202, a game provider 204, a player information system 206, a financial system 208, a game player 210, a game organizer 212, a game sponsor 214, a communications network 216 and computer systems 218, 220 and 222. As illustrated, the game broker 202, the game provider 204, the player information system 206, the financial system 208 and the computer systems 218, 220 and 222 are interconnected and may exchange information via the network 216. The network 216 may include any communication network through which member computer systems may exchange data. For example, the network 216 may be a public network, such as the internet, and may include other public or private networks such as LANs, WANs, extranets and intranets.

The sundry computer systems shown in FIG. 2, which include the game broker 202, the game provider 204, the player information system 206, the financial system 208, the network 216 and the computer systems 218, 220 and 222 each may include one or more computer systems. As discussed above with regard to FIG. 1, computer systems may have one or more processors or controllers, memory and interface devices. The particular configuration of system 200 depicted in FIG. 2 is used for illustration purposes only and examples in accord with the invention may be practiced in other contexts. Thus, the invention is not limited to a specific number of users or systems.

In the examples in accord with FIG. 2, the game player 210, the game organizer 212 and the game sponsor 214 may interact with the game broker 202, the game provider 204, the player information system 206 and the financial system 208 using computer systems 218, 220 and 222 via the network 216. In one such example, the game broker 202, the game provider 204, the player information system 206 and the financial system 208 serve browser-based user interfaces to the game player 210, the game organizer 212 and the game sponsor 214. In this example, the computer systems 218, 220 and 222 render these browser-based user interfaces using a browser application, such as Microsoft Internet Explorer.

With continuing reference to FIG. 2, the game broker 202 may include facilities, e.g. executable code, data structures or objects, configured to broker games administered by the game provider 204 to the game player 210 using the distributed computer system 200. The term "game" is meant to encompass all types of multiplayer games including those of physical or mental skill and chance and includes games which may require an entry fee or wager of a financial value and a wager of consideration, as well as games which may not require wagers of any value to play. Games may be played against another player or players such as in a sweepstakes or tournament or league play. One of ordinary skill recognizes there are a vast number of games and more are created with each passing day. Examples disclosed herein may be used with any type of game.

The term "electronic game" refers to any game which is at least partially implemented on an electronic device. For example, all or part of a game may be conducted on a personal computer, a computer terminal, a cell phone such as Palm's Treo 700w, 755p and other variants, a music player such as Apple's iPod, a personal data assistant such as a Blackberry, portable video game such as Nintendo's DS game console or a home video game such as Nintendo's Wii game console or Microsoft's Xbox 360. One of ordinary skill recognizes there is a wide array of electronic devices which may be adapted for convenient game play that may be used to implement various examples consistent with principles of the invention. All such devices are contemplated for use with examples disclosed herein.

An electronic game may also be conducted on a purpose-built electronic device such as a slot machine, a video arcade machine or other electronic gaming machine, such as a general purpose gaming terminal. The electronic game may be downloaded from a central server to the general purpose gaming terminal as part of an overall server based gaming system. Furthermore, the electronic game may communicate with a casino management system or other player information system to establish player identity, track player game preferences and exchange other player related information.

Other non-electronic elements that may be used, in part, to conduct electronic game play, include manually tracked fantasy sports teams, card games and crossword puzzles. One of skill in the art recognizes there are many desirable ways to combine manual game elements with electronic game play, and this disclosure includes all such manual game elements within the scope of the meaning of "electronic game". Moreover, optical and biological computing devices are in development that perform the equivalent work of today's electronic devices. One of skill in the art appreciates that our invention is useful with such technologies, and this disclosure includes them within the definition of "electronic game."

One example illustrated by FIG. 2 resides within the context of a fantasy sports league. In this example, the distributed computer system 200 is configured to allow the game organizer 212 to act as a fantasy league commissioner. In this role, the game organizer 212 may invite one or more game players, such as game player 210, to act as team owners and to participate in a web-based fantasy sports league hosted by the game provider 204. Alternatively, the game broker 202, itself, may act as the game organizer 212 and automatically perform the functions of the fantasy league commissioner, thus absolving any individual from performing the role.

The game provider 204 shown in FIG. 2 includes facilities configured to receive game configuration information from the game broker 202 and to create games based at least in part on the game configuration information received. Within the context of a fantasy sports league, this game configuration information may include the type of sport upon which the fantasy league is based, the number of players in the league and assorted other rules governing league play and the monetary costs and rewards associated with individual performance within the league.

According to other examples directed toward fantasy sports leagues, the game broker 202 includes facilities configured to enable the game organizer 212 to identify players such as the game player 210 as potential team owners by exposing data gathered by the game broker 202 in combination with data gathered from a casino loyalty system or other player information system, such as the player information system 206.

According to various examples, the player information system 206 may be a player information system as disclosed by way of example in U.S. Patent Application Ser. No. 61/016,801 filed Dec. 26, 2007 entitled "SYSTEM AND METHOD FOR COLLECTING AND USING PLAYER INFORMATION", which is incorporated herein by reference in its entirety. In some examples, the player information system 206 may include social networking sites, such as FACEBOOK.COM, MYSPACE.COM and LINKEDIN.COM, as well as other systems with potential player information, such as AMAZON.COM, ITUNES.COM AND YAHOO.COM. In at least one example, the player information system 206 includes facilities configured to receive and parse qualification criteria from the game broker 202. In this example, the player information system 206 can identify potential game players having the qualification criteria and can transmit player identification data for players having the qualification criteria back to the game broker 202.

Furthermore, in this example, the game broker 202 can interact with systems administered by financial institutions, such as the financial system 208, to deposit or withdrawal money associated with the fantasy sports league, e.g. entry fees or rewards. Additionally, in this example, the game broker 202 has facilities configured to allow the game sponsor 214 to sponsor a sports league reward. The game sponsor 214 may be a third party, such as a sporting goods equipment retailer. Further, the reward may be donated in exchange for a grant of advertising access to the game players in the league.

Example System Architecture

Figure 3:
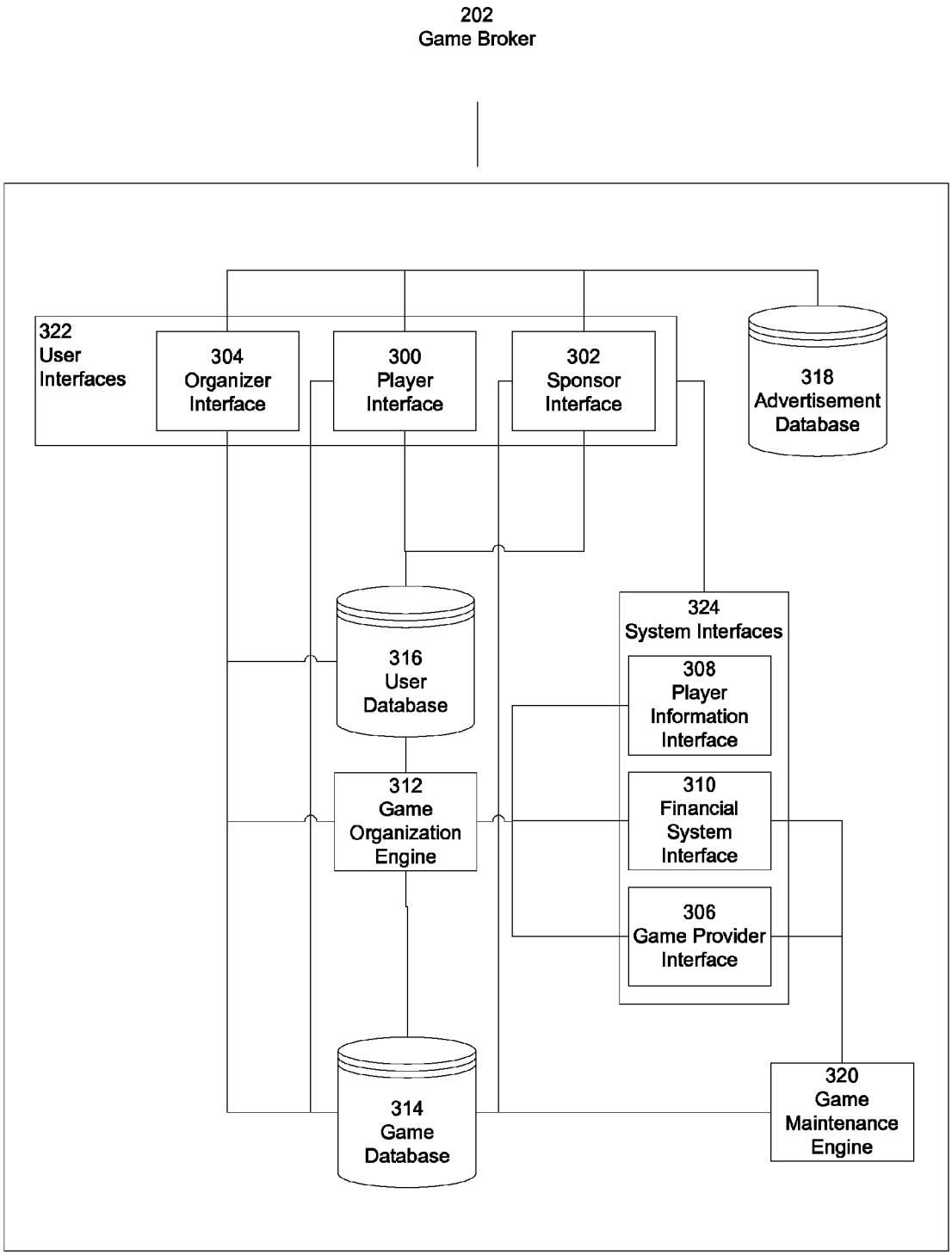
FIG. 3 depicts an example system architecture in accord with the present invention.

FIG. 3 provides a more detailed illustration of a particular physical and logical configuration of the game broker 202. The system structure and content discussed below are for exemplary purposes only and are not intended to limit the invention to the specific structure shown in FIG. 3. As will be apparent to one of ordinary skill in the art, many variant system structures can be architected without deviating from the scope of the present invention. The particular arrangement presented in FIG. 3 was chosen to promote clarity.

In the example shown in FIG. 3, the game broker 202 includes a game organization engine 312, a game maintenance engine 320, a game database 314, a user database 316, an advertisement database 318 and a set of user interfaces 322 and a set of system interfaces 324. The set of user interfaces 322 includes a player interface 300, a sponsor interface 302 and an organizer interface 304. The set of system interfaces includes a game provider interface 306, a player information interface 308 and a financial system interface 310.

The elements illustrated in FIG. 3 include facilities that are configured to exchange information as follows. Each of the user interfaces 322 can to exchange information with the each of databases 314, 316 and 318. Also, in some examples, each of the user interfaces 322 can exchange information with each of the system interfaces 324 and the game organization engine 312.

In one example, each of the system interfaces 306, 308 and 310 can exchange information with a variety of external entities. For example, the game provider interface 306 can exchange information with game provision systems, such as the game provider 204. The player information interface 308 can exchange information with player information systems, such as the player information system 206. In addition, the financial system interface 310 can exchange information with systems of financial institutions, such as financial system 208.

According another example, both the game organization engine 312 and the game maintenance engine 320 can exchange information with the game provider interface 306 and the financial system interface 310. Moreover, both the game organization engine 312 and the game maintenance engine 320 can exchange information relating to games with the game database 314 and information relating to user with the user database 316. In addition, the game organization engine 320 can exchange game related information with each of the user interfaces 332 and can exchange information related to players with the player information interface 308.

Information may flow between the elements, components and subsystems described herein using any technique. Such techniques include, for example, passing the information over the network via TCP/IP, passing the information between modules in memory and passing the information by writing to a file, database, or some other non-volatile storage device. In addition, pointers or other references to information may be transmitted and received in place of, or in addition to, copies of the information. Conversely, the information may be exchanged in place of, or in addition to, pointers or other references to the information. Other techniques and protocols for communicating information may be used without departing from the scope of the invention.

With continued reference to FIG. 3, the game database 314 may include facilities configured to store and retrieve game related information. This game information may include, among other information, historical game information and game configuration information. Historical game information may include any information related to previously conducted games or games that are currently being conducted. Examples of historical game information include, among other information, the current status of a game, how individual players are performing in a game, the completion time of a game, winning players, losing players, rewards won, detailed information regarding player performance during the game and the margins of victory and defeat.

Game configuration information may include any game settings that when altered, modify the game playing experience. Examples of game configuration information include the number of players, the level of difficulty, rules governing entry and authorization of reward redemption, prize data and time restrictions on game play and reward redemption. The term "specified time period" indicates a period before or after a specific time and date or a period within a beginning and ending time and date. The term also includes a recurring time period, such as every Wednesday, every Tuesday afternoon between the hours of 2 and 5 PM, the last Monday of each month, every Fourth of July, this coming Fourth of July, etc. One of skill in the art readily understands there are many other permutations and combinations of one-time and recurring time restrictions that can be useful with examples in accord with the present invention and representation of all such permutations and combinations is intended by the term "specified time period" and its variants.

Game configuration information may also include prize data. Prize data may indicate characteristics of one or more rewards. Rewards may include cash, merchandise, points, free games, non-cashable credits (credits which may be wagered in a game but not converted to cash), cashable credits (credits which may be wagered in a game or converted to cash), coupons (including physical, such as paper, and electronic), entry into other games, qualification for other games, entry into tournaments, qualification for tournament entry, or other such means. One of ordinary skill recognizes there are a wide variety of rewards and more are created with each passing day. All such forms of rewards are contemplated for use with examples disclosed herein. For instance, the prize data may indicate the type of reward, the entity sponsoring the reward, the identity of the reward, how the reward may be redeemed, bank account numbers, etc. More particularly, in at least one example the reward may be provided by one or more players, such as by the players' entry fees.

The user database 316 shown in FIG. 3 includes facilities configured to store and retrieve user information. This user information may include, among other information, any information regarding users in general and information regarding specific types of users such as game players, game organizers and game sponsors. Examples of general user information include, among other information, demographic information, account information, such as financial account information, identification information and security information, and user type information, e.g. whether the user is game organizer, game sponsor or game player. Examples of information relating specifically to game players include skill level information, reward information, available alternative methods of entry in games and references to the game database 314 that are pertinent to individual game players. Examples of such references include references to games available to players, references to the status of games being played by the player and references to historical game information involving the player. In addition, game player information may also include game configuration preference information.

According to several examples, game configuration preference information may indicate specific types of games that a user prefers or information about games with which the user has a history. For instance, the game configuration preferences may indicate a certain set of rules that a particular user prefers to follow when playing a game. In another example, the game configuration preferences may indicate a certain entry fee structure is preferred by a group of users. In still another example, the game configuration preferences may indicate a particular reward payout structure is preferable. The game configuration preferences may also be based at least in part on the usage history of the user.

The advertisement database 318 illustrated in FIG. 3 includes facilities configured to store and retrieve advertisement information. This advertisement information may include, among other information, any information relating to products or services that a game sponsor, such as the game sponsor 214, wishes to promote via the game broker 202. The advertisement information may include any information that can be communicated using a computer system. Examples of advertisement information include, among others, multimedia presentations, references to other websites, text and other content or computer automation.

The databases 314, 316 and 318 may take the form of any logical construction capable of storing information on a computer readable medium including flat files, indexed files, hierarchical databases, relational databases or object oriented databases. In addition, links, pointers, indicators and other references to data may be stored in place, of or in addition to, actual copies of the data. The data may be modeled using unique and foreign key relationships and indexes. The unique and foreign key relationships and indexes may be established between the various fields and tables to ensure both data integrity and data interchange performance.

As depicted in FIG. 3, the game broker 202 may expose one or more interfaces to external entities to exchange data pertinent to the functions of the entities. For example, each of the user interfaces 322 and the system interfaces 324 may include facilities configured to setup an entity identifier during initial registration of an entity. In addition, the user interfaces 322 and the system interfaces 324 may have facilities configured to request an entity identifier prior to providing functionality to an entity. The term "identifier" indicates a device, code or technique used to recognize a particular person or system. The identifier may simply be an account number or code associated with the entity's account or username or alias selected by the entity. The identifier may also be biometric, such as a fingerprint, hand shape recognition or eye-pattern recognition. One of ordinary skill recognizes there is a wide range of ways to identify a person or system uniquely, or as a member of a group, and all such techniques are anticipated as useful with examples disclosed herein.

The user interfaces 322 shown in FIG. 3 includes facilities configured to enable the game broker 202 to exchange a variety of information with users, such as the game player 210, the game organizer 212 and the game sponsor 214. This information includes, among other information, information stored in the game database 314, the user database 316 and the advertisement database 318. In various examples, the user interfaces 322 employ a wide variety of user interface elements and interface metaphors to exchange this information with users of the game broker 202. According to various examples, the user interfaces 322 include facilities configured to provide common functions across each of the individual the user interfaces 300, 302 and 304.

For example, each of the user interfaces 322 has facilities configured to receive advertisement information from the advertisement database 318 and to display the advertisement information to users. These advertisement facilities may tailor the advertisement information displayed based on a variety of factors including characteristics of the user, the particular activity being performed by the user and the click-through rate of the advertisement information.

In another example, each of the user interfaces 322 has facilities configured to receive from users, and store in the user database 316, financial account information that identifies financial accounts held by the user. These financial accounts may be accounts established in one or more external financial systems such as the financial system 208. As is discussed further below, the game broker 202 may utilize this financial account information to transfer funds to and from the user's financial accounts based on the actions taken by the user within the game broker 202.

In other examples, each of the user interfaces 322 may include facilities configured to allow users to identify groups of users who share common characteristics. Using these facilities, a user, such the game player 210, the game organizer 212, or the game sponsor 214 can identify a group of potential game players. In some examples, each of the user interfaces 322 receive a set of target characteristics from users and identify users that match the target characteristics by exchanging information with a player information system via the player information interface 308.

Also, in these examples, each of the user interfaces 322 can generate qualification criteria specifying target attributes common to potential game players and transmit the qualification criteria via the player information interface 308. The qualification criteria may specify any attribute that may be associated with a game player. For example, the qualification criteria may specify that the game player should be a member of a loyalty club, have a specified level of skill, have a specified value as a gambler, be older than a specified age or have an income greater than a specified level. The level of skill of a player may be determined using in various ways including the player's historical game playing performance. As discussed above, with regard to the player information system 206, a player information system may respond with information indicating any players who match the qualification criteria. In addition, each of the user interfaces 322 may search the user database 316 and the game database 314 to find game players who match the qualification criteria.

In another example, each of the user interfaces 322 has facilities configured to allow users to invite game players to play particular games. With these facilities, users can identify and invite an individual player or a group of game players. Invitations can take on various forms and may be transmitted using a variety of tools and techniques. For example, the player interface 300 may issue invitations using any electronic method currently available or hereafter discovered including email, personal messaging, instant messaging, SMS text messaging, MMS text messaging and TWITTER messaging. The invitations may also be sent via other communication conduits including ordinary mail, fax, pager and common telephone service. The invitations may include a specific game that may be of interest to the player or may include multiple games.

In various examples, each of the user interfaces 322 includes facilities configured to enable users to approve entry requests of players for particular games according to the rules governing entry for the particular games. In one example, these rules are stored in the game database 314. In some examples, the rules may require that any one user, such as a game player, game organizer or game sponsor, or some combination of users approve a player's request for entry into the game. In these examples, the user interfaces 322 can present a list of players who have requested to participate in a particular game and can receive an indication to approve entry of players into the particular game. In one example, each of the user interfaces 322 can record approval of specific requests in the game database 314.

As will be discussed further below, players whose entry requests have been approved may be prevented from playing a particular game by the game organization engine 312. For example, the entry of a player may also depend on the player paying an entry fee or entering via an alternative method of entry. Alternative methods of entry are disclosed by way of example in U.S. patent application Ser. No. 11/049,399 entitled "SYSTEMS AND METHODS FOR PLAYING GAMES OF CHANCE OR SKILL USING AN ALTERNATE METHOD OF ENTRY," which is hereby incorporated by reference in its entirety.

In some examples, each of the user interfaces 322 has facilities configured to allow users to view game related information such as the information discussed above with regard to the game database 314. For instance, in one example, each of the user interfaces 322 can display the current status of active, or recently completed, games which are associated with a user. In another example, the user interfaces 322 can display, for pending and inactive games associated with the user, the game configuration and the number and identity of players who have entered the game.

In other examples, each of the user interfaces 322 includes facilities configured to authorize redemption of rewards for particular games according to the rules governing redemption for the particular games. In one example, these rules are stored in the game database 314. As with the rules governing approval, rules governing authorization for redemption may require that any one user or some combination of users authorize redemption prior to releasing a reward. In these examples, the user interfaces 322 can display users eligible for authorization for redemption and can receive one or more indications of users authorized to redeem rewards for the particular game. According to these examples, each of the user interfaces 322 can record authorizations for redemption in the game database 314.

In another example in accord with FIG. 3, the organizer interface 304 has facilities configured to display configurable game options and to receive game configuration information, as discussed above with regard to the game database 314, from game organizers, such as game organizer 212. In this example, the organizer interface 304 can also store the received configuration information in the game database 314. This game configuration information may be generated from the personal knowledge, from the game configuration preferences of the game organizer, or from a commission request from a game sponsor or player. Game commissions are discussed further below.

In another example illustrated by FIG. 3, the organizer interface 304 includes facilities configured to allow game organizers to develop game configuration information based on information gathered from a player information system via the player information interface 308. In one example, the information gathered from the player information system may indicate the game configuration preference information of the players. In another example, the information gathered from the player information system may be combined with information stored in the game broker 202 to develop the game configuration preferences. In these examples, the organizer interface 304 can store the game configuration preference information in the user database 316. In an additional example, the organizer interface 304 is configured to transmit the game configuration information to a game provider via the game provider interface 306. As discussed above with regard to the game provider 204, a game provider can receive the game configuration information and can create games based at least in part on the game configuration information.

In one example, the organizer interface 304 includes facilities configured to allow the game organizer to delegate one or more game configuration settings to one or more game players. According to this example, the organizer interface 304 can, when presenting the various configurable game options to the game organizer, receive an indication that one or more configurable game options are to be set by a particular player or by a majority of a group of players.

In another example illustrated by FIG. 3, the player interface 300 has facilities configured to exchange a variety of information with game players. For instance, in one example, the player interface 300 has facilities configured to allow players to commission games from game organizers. Commission of games is discussed further below.

In another example, the player interface 300 includes facilities configured to enable game players to request entry into games in a variety of ways. In one example, the player interface 300 includes a user interface screen that can retrieve and display game information stored the game database 314. In this example, the player interface 300 is configured to allow game players to request entry into one or more games and to store a player's requests for games in the game database 314.

According to various examples, the successful entry of a player into a particular game may depend on a variety of conditions. For example, the entry of a player may depend on the player being approved by a game organizer, other game players, a game sponsor or a combination thereof, as discussed above. Again as discussed above, the entry of a player may depend on the player paying an entry fee or entering via an alternative method of entry such as the alternative method of entry. Also as discussed above, the entry of a player may depend on the player being qualified.

For example, the player interface 300 can prevent a player from entering games for which the player is not qualified. For instance, the player interface 300 may restrict entry by disabling the player's ability to select games. In another example, the player interface 300 may prohibit entry by not displaying in the list games for which the user is not qualified.

In some examples, the player interface 300 includes facilities configured to allow players to select a portion of the configurable game options for a game according to the game configuration information setup by the game organizer. As discussed above, in one example, the game organizer may delegate one or more configurable game options to a particular game player or to a group of game players. In this example, the player interface 300 includes a user interface screen that can present delegated configurable game options to the designated player or players and can receive response indications from the designated player or players. Further, this user interface screen is configured to determine the delegated configurable option with the most indications from the designated players and store this configurable option in the game database 314.

In another example in accord with FIG. 3, the sponsor interface 302 includes facilities to allow sponsors, such as the game sponsor 214, to perform a variety of functions regarding the provision and administration of games, rewards and advertisements. For instance, in one example, the sponsor interface 302 includes facilities configured to allow sponsors to select, or bid for, one or more games for which they would like to provide a reward.

In this example, the sponsor interface 302 can also receive prize information identifying one or more rewards to be won by game players and reward control information specifying any information required for the game broker to gain control of the prize. This control information may include, among other information, credit card information or contact information for the current possessor of the reward. According to this example, game sponsors are provided the opportunity to present advertisements to game players in exchange for sponsoring rewards. Thus, in this example, the sponsor interface 302 also includes facilities configured to receive advertisement information and store the advertisement information in the advertisement database 318 for later presentation to game players.

In some examples, the sponsor interface 302 has facilities that enable sponsors to commission game organizers to organize games that draw game players with specific characteristics. These player characteristics may include, among other characteristics, income level, occupation and assessed gambling value. In one example, the sponsor interface 302 can receive one or more target player characteristics and provide the target player characteristics to game organizers.

Each of the interfaces disclosed herein exchange information with various providers and consumers. These providers and consumers may include any external entity including, among other entities, users and systems. In addition, each of the interfaces disclosed herein may both restrict input to a predefined set of values and validate any information entered prior to using the information or providing the information to other components. Additionally, each of the interfaces disclosed herein may validate the identity of an external entity prior to, or during, interaction with the external entity. These functions may prevent the introduction of erroneous data into the system or unauthorized access to the system.

In another example illustrated by FIG. 3, the game organization engine 312 includes facilities configured to support a variety of game setup and configuration functions including functions normally performed by a game organizer such as the game organizer 212. These functions may include indentifying players, configuring games to suit the preferences of the players or the requirements of a sponsor commission, suggesting games to players or issuing invitations to the players based on player's game configuration preferences, collecting fees from the players, collecting rewards from any sponsors and approving player requests to enter games. In addition, the game organization engine 312 has facilities configured to interoperate with the other components of the game broker 202 as needed to support game organization functions.

For example, as discussed above with regard to approval of player entry requests, approved players may be required to pay an entry fee or provide some alternative method of entry prior to entering and participating in a game. In examples configured to deal with this situation, the game organization engine 312 has facilities configured to scan the game database 314 for approved players who need to pay entry fees, collect the entry fees, via the financial system interface 310, using the financial account information stored in the user database 316 and place the collected entry fees into a holding account via the financial system interface 310. In various examples, the game organization engine 312 can generate deposit data for transmission to a financial institution. The deposit data may indicate a deposit amount and a bank account. In some examples, the bank account may be an escrow account. In addition, the game organization engine 312 may have facilities to verify that a user is entitled to an alternative method of entry by scanning the user database 316 for this information.

In these examples, if the game organization engine 312 is unable to collect entry fees or verify an alternative method of entry for an approved player, the game organization engine 312 prevents that player from playing the game by recording this deficiency in the game database 314. Otherwise, the game organization engine 312 allows the player to enter and play the game by recording payment or verification of an alternative method of entry in the game database 314 and by generating game entry data indicating the player and the game that the player wishes to enter. In this example, the game engine 312 transmits the game entry data via the game provider interface 306 to one or more game systems, such as the game provider 204, to facilitate the entry of the player into his game.

In another example, the game organization engine 312 includes facilities configured to collect sponsor rewards. The game organization engine 312 can collect the reward by, for example, charging a credit card and placing the resulting funds in a holding account such as an escrow account. The game organization engine 312 may collect non-monetary rewards by requesting delivery of the reward to a specific location, or simply by putting the possessor of the reward on notice of the game broker's rights, via email or some other form of electronic communication.

In another example illustrated by FIG. 3, the game maintenance engine 320 includes facilities configured to support a variety of game operational functions including functions normally performed by a game organizer such as the game organizer 212. These functions may include receiving and recording, in the game database 314, outcomes from games, processing redemption requests for rewards and distributing rewards. When combined, the game maintenance engine 320 and the game organization engine 312 may automatically perform all of the functions of a game organizer, such as the game organizer 212. In addition, the game maintenance engine 320 has facilities configured to interoperate with the other components of the game broker 202 as needed to support game maintenance functions.

For example, the game maintenance engine 320 includes facilities configured to receive and parse historical game information describing on-going or completed games. In various examples, the game maintenance engine 320 is configured to receive the historical game information via the game provider interface 306. In these examples, the game maintenance engine 302 also has facilities configured to store the historical game information in the game database 314. In an addition example, the game maintenance engine 320 is also configured to determine any applicable rewards based at least in part of the outcomes included in the historical game information and submit these rewards for authorization according to the applicable game configuration information.

In another example, the game maintenance engine 320 has facilities configured to receive authorization data indicating that a particular reward should be distributed. In this example, the game maintenance engine 320 can generate reward data based on the reward to be distributed. According to this example, the game maintenance engine 320 can also provide the reward data to a reward entity such as a financial institution via the financial system interface 310 or to another rewards supplying entity via another electronic communication. The reward data may indicate at least one reward to be provided to the authorized user.

Fantasy Leagues

Figure 4:
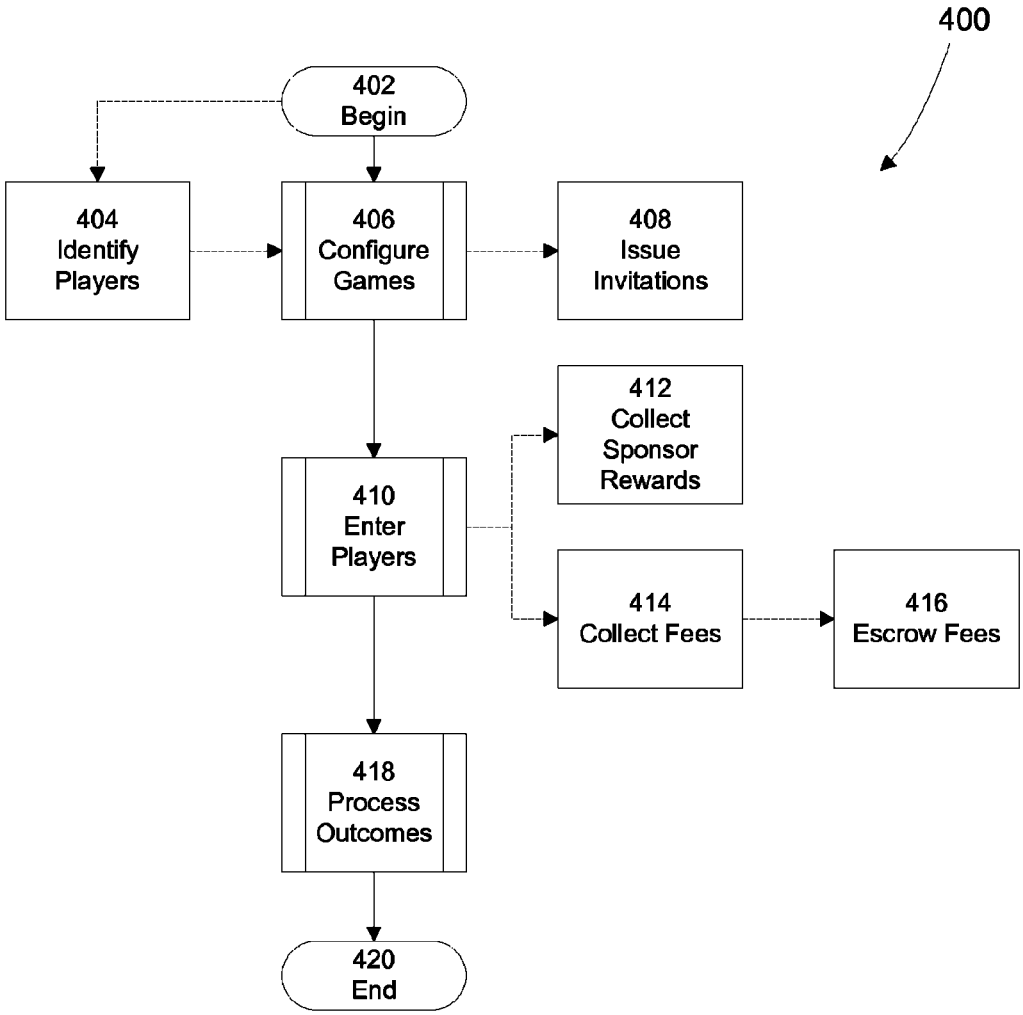
FIG. 4 shows an example process for broking games.

Various examples provide processes for brokering a fantasy league game. FIG. 4 illustrates one such process 400 that includes acts of identifying players, configuring games, issuing invitations, accepting players, collecting sponsor rewards, collecting player entry fees, escrowing player entry fees, receiving game outcomes, processing redemption requests and distributing rewards. While the following discussion will place this method in the context of a fantasy league, it should be appreciated that the method is not limited to that context and may be used with any game. In this fantasy league example, the game organizers are termed "league commissioners" and game players are termed "team owners." Process 400 begins at 402.

In act 404, players are identified. According to various examples, a computer system automatically identifies players without assistance from a league commissioner. In these examples, the computer system that identifies the players is a computer system arranged and configured in accord with the game broker 202 described above.

According to other examples, league commissioners identify players based on player information associated with the team owners. Additionally, the league commissioners qualify team owners for entry into their leagues as part of the act of identifying players. The term "qualified" indicates that a person or persons are allowed to play in a league, based on a variety of criteria, segmented into specific categories. Each qualified category may be eligible as a search criterion for finding players. As previously discussed, qualification is important because of the myriad styles of fantasy league play available and the team owners desire to play with knowledgeable like-mind players. It is therefore desirable to qualify people according to their perceived value to the prospective league. Such qualification may be based upon criteria such as team owners desire to play, geographical location/location of residence, any/all school affiliations, employment history, occupation, personal interests, performance history/skill at game play, the value to the game providers of the player as a gambler, preferred style of play, team preferences, membership in loyalty clubs, current entry fee level or even projected entry fee levels based upon the details of a potential player's occupation, income level, age, gender, background, personal preferences, location of residence, employment history and other such criteria, either alone or in combination.

In act 406, games are configured. In various examples, a specially configured computer system configures games automatically. Acts in accord with these examples are discussed below with reference to FIG. 5.

According to other examples, a league commissioner configures games using a computer system specially configured in accord with the game broker 202 described above. According to these examples, the league commissioner configures a fantasy league to match the preferences of the league commissioner or the team owners. Such configuration may be accomplished based upon the knowledge of the league commissioner regarding the preferences of the team owners or with the assistance of a player information system. In this example, using the organizer interface 304 described above, the league commissioner configures a set of league rules, including an entry fee structure and a reward payout structure, according to the preferences of team owners.

In act 408, invitations are issued. According to some examples, a computer system automatically issues invitations without assistance from a league commissioner. In these examples, the computer system that issues the invitations is a computer system arranged and configured in accord with the game broker 202 described above.

In other examples, a commissioner issues an invitation to one or more owners to join his fantasy league. In this example, the term "invitation" refers to a request extended to a qualifying person to participate in a league. Invitations may be communicated using any suitable technology, including but not limited to, email, instant messenger, short message service, written and verbal means. One of ordinary skill recognizes there is a wide range of ways to invite a person uniquely, or as a member of a group, and all such ways are anticipated as useful with examples disclosed herein.

In act 410, entry into the games is requested. In some examples, a specially configured computer system configures games automatically. Acts in accord with these examples are discussed below with reference to FIG. 6.

According to other examples, invited players who wish to participate in the fantasy league are approved automatically or upon manual approval by the league commissioner or by the approval of the other team owners. Part of the act of entry may include collecting entry fees from the game players. Any fees collected may be escrowed with a financial institution via manual or electronic methods.

According to at least one example, the league may approve an alternative method of entry or may not require fees. Furthermore, the league commissioner may solicit and receive rewards from a third party sponsor in exchange for advertising access to the team owners who are members of the league. For example, a hockey memorabilia vendor may provide a jersey associated with a famous hockey player in exchange for the ability to email fantasy hockey participants regarding the available hockey merchandise.

In act 412, sponsor rewards are collected. According to various examples, a computer system automatically collects sponsor rewards without assistance from a league commissioner or other user. In these examples, the computer system that collects the rewards is a computer system arranged and configured in accord with the game broker 202 described above.

In act 414, fees are collected. According to various examples, a computer system automatically collects fees without assistance from a league commissioner. In these examples, the computer system that collects the fees is a computer system arranged and configured in accord with the game broker 202 described above.

In act 416, fees are escrowed. According to various examples, a computer system automatically escrows fees, and other monetary rewards, without assistance from a league commissioner. In these examples, the computer system that escrows the fees and other monetary rewards, is a computer system arranged and configured in accord with the game broker 202 described above.

In act 418, game outcomes are processed. In some examples, a specially configured computer system process outcomes automatically. Acts in accord with these examples are discussed below with reference to FIG. 7.

According to other examples, outcomes or winnings are redeemed by a qualified team owner who is permitted to redeem the outcomes or winnings by some or all of the other team owners via an approval proxy vote or by the approval the league commissioner or by a combination of both. This redemption process is initiated and authorized through a user interface as described above. The term "redeem" indicates the redemption of an outcome which may result in the award of merchandise, free or reduced cost play of fee-based games, cash, gift certificates or other such collateral. Some outcomes may result in opportunity to play additional games, which must be won in order to obtain a prize or enhance the value of an initial prize. One of ordinary skill recognizes there are a wide variety of ways, both manual and automated, by which winner persons may be allowed to redeem prizes won outcomes and more are being created with each passing day. All such methods are contemplated for use with examples disclosed herein.

In additional examples, the authorized rewards are distributed in a manner suitable for the reward. For example, if the reward is a monetary reward, the winner's reward is distributed via electronic funds transfer. If the reward is a physical item, the reward is distributed via the US mail.

Process 400 ends at 420. Brokering activities in accord with process 400 provide a wide variety of benefits including enabling game brokers to build communities of game players with similar gaming preferences, enhancing the entertainment value of games for game players and providing sponsors with highly relevant audiences for targeted marketing campaigns.

Figure 5:
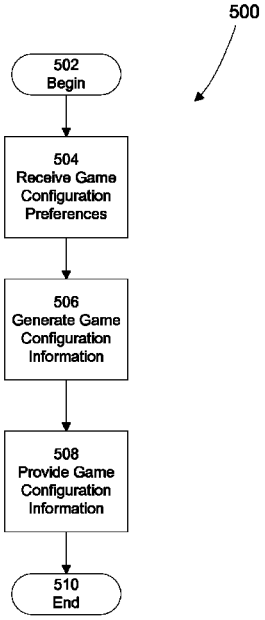
FIG. 5 illustrates an example process for configuring games.

Various examples provide processes for configuring games. FIG. 5 illustrates one such process 500 that includes acts of receiving game configuration preferences, generating game configuration information and providing game configuration information. Process 500 begins at 502

In act 504, a computer system receives game configuration preferences. In one example, the computer system that receives the preferences is a computer system arranged and configured in accord with the game broker 202 described above. In this example, the game configuration preferences are automatically generated by the game organization engine 312 and stored in the user database 316.

In act 506, a computer system generates game configuration information. In one example, the computer system that generates the configuration information is a computer system arranged and configured in accord with the game broker 202 described above. In this example, the game configuration information is automatically generated by the game organization engine 312 and stored in the game database 314.

In act 508, a computer system provides the game configuration information. In one example, the computer system that provides the configuration information is a computer system arranged and configured in accord with the game broker 202 described above. In this example, the game organization engine 312 provides the game configuration information to an external game provider, such as game provider 204, via the game provider interface 306.

Process 500 ends at 510.

Figure 6:
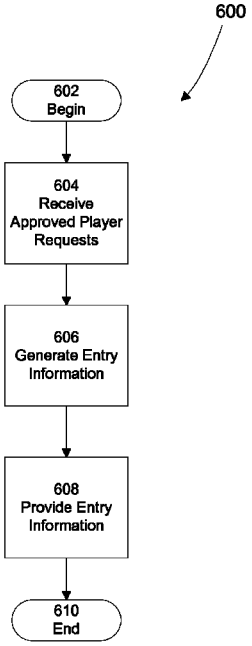
FIG. 6 depicts an example process for entering players into games.

Various examples provide processes for entering player into games. FIG. 6 illustrates one such process 600 that includes acts of receiving approved player requests for entry into games, generate game entry information and providing game entry information. Process 600 begins at 602

In act 604, a computer system receives approved player requests. In one example, the computer system that receives the approved requests is a computer system arranged and configured in accord with the game broker 202 described above. In this example, the approved player requests from a user via the user interfaces 322 and stored in the game database 314.

In act 606, a computer system generates game entry information. In one example, the computer system that generates the entry information is a computer system arranged and configured in accord with the game broker 202 described above. In this example, the game entry information is automatically generated by the game organization engine 312.

In act 608, a computer system provides the game entry information. In one example, the computer system that provides the entry information is a computer system arranged and configured in accord with the game broker 202 described above. In this example, the game organization engine 312 provides the game entry information to an external game provider, such as game provider 204, via the game provider interface 306.

Process 600 ends at 610.

Figure 7:
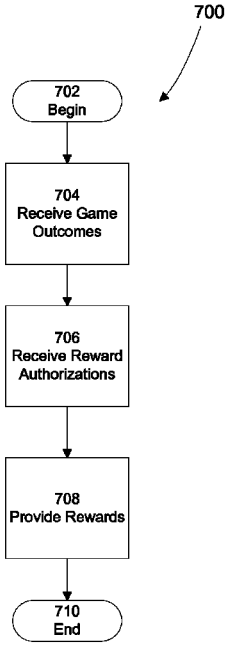
FIG. 7 shows an example process for processing outcomes of games.

Various examples provide processes for processing outcomes. FIG. 7 illustrates one such process 700 that includes acts of receiving game outcomes, receiving reward authorizations and providing rewards. Process 700 begins at 702

In act 704, a computer system receives game outcomes. In one example, the computer system that receives the game outcomes is a computer system arranged and configured in accord with the game broker 202 described above. In this example, the game outcomes are received from an external game provider via the game provider interface 306 and stored in the game database 314.

In act 706, a computer system receives reward authorizations. In one example, the computer system that receives the authorizations is a computer system arranged and configured in accord with the game broker 202 described above. In this example, the reward authorizations are received via the user interfaces 322 and stored in the game database 314.

In act 708, a computer system provides the authorized rewards. In one example, the computer system that provides the rewards is a computer system arranged and configured in accord with the game broker 202 described above. In this example, the game maintenance engine 320 provides the authorized rewards via the financial system interface 310.

Process 700 ends at 710.

Each of processes 400, 500, 600 and 700 depicts one particular sequence of acts in a particular example. The acts included in each of these processes may be performed by, or using, one or more computer systems specially configured as discussed herein. Some acts are optional and, as such, may be omitted in accord with one or more examples. Additionally, the order of acts can be altered, or other acts can be added, without departing from the scope of the present invention. In at least one example, the acts disclosed herein are performed on a particular, specially configured machine, namely a computer system configured as a game broker. In addition examples in accord with the present invention may be implemented in one or more systems disclosed by way of example in U.S. patent application Ser. No. 11/841,754 entitled "METHOD AND APPARATUS FOR PROVIDING PLAYER INCENTIVES" filed Aug. 20, 2007, which is incorporated herein by reference in its entirety.

Any references to examples or elements or acts of the systems and methods herein referred to in the singular may also embrace examples including a plurality of these elements, and any references in plural to any example or element or act herein may also embrace examples including only a single element. References in the singular or plural form are not intended to limit the presently disclosed systems or methods, their components, acts, or elements.

Any example disclosed herein may be combined with any other example, and references to "an example," "some examples," "an alternate example," "various examples," "one example," "at least one example," "this and other examples" or the like are not necessarily mutually exclusive and are intended to indicate that a particular feature, structure, or characteristic described in connection with the example may be included in at least one example. Such terms as used herein are not necessarily all referring to the same example. Any example may be combined with any other example in any manner consistent with the aspects disclosed herein. References to "or" may be construed as inclusive so that any terms described using "or" may indicate any of a single, more than one, and all of the described terms.

Where technical features in the drawings, detailed description or any claim are followed by references signs, the reference signs have been included for the sole purpose of increasing the intelligibility of the drawings, detailed description, and claims. Accordingly, neither the reference signs nor their absence have any limiting effect on the scope of any claim elements.

Having now described some illustrative aspects of the invention, it should be apparent to those skilled in the art that the foregoing is merely illustrative and not limiting, having been presented by way of example only. While the portions of this disclosure are focused on examples including fantasy leagues, aspects of the present invention may be applied to other games, for example, casino games and classic skill games such as chess. Similarly, aspects of the present invention may be used to achieve other objectives including enabling gaming sites to more profitably deliver gaming entertainment to game players by decreasing the staff required to administer the gaming sites. Numerous modifications and other illustrative examples are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives.

What is claimed is:

1. A system for brokering games comprising:

a network interface configured to exchange data on a network;

a controller coupled to the network interface and configured to:

generate configuration data for transmission via the network interface to at least one of a plurality of game systems, the configuration data indicating at least one of the plurality of games and being based at least in part on a set of preferences gathered from at least one of a plurality of players, the configuration data also including criteria determined by a game provider and independent of player influence that can override the preferences gathered from the players in order to ensure players with, at least, a specified value as a gambler participate in the at least one of the plurality of games;

generate entry data for transmission via the network interface to the at least one of the plurality of game systems, the entry data indicating at least one player from the plurality of players and indicating the at least one of the plurality of games;

parse outcome data received via the network interface from the at least one of the plurality of game systems, the outcome data indicating at least one winner of the at least one of the plurality of games;

parse authorization data received via the network interface; and generate reward data for transmission via the network interface to at least one reward entity, the reward data indicating at least one reward and the at least one winner.

2. The system according to claim 1, wherein the at least one of the plurality of games includes a fantasy league game.

3. The system according to claim 1, wherein the set of preferences indicates a set of rules for the at least one of the plurality of games.

4. The system according to claim 1, wherein the set of preferences indicates an entry fee structure for the at least one of the plurality of games.

5. The system according to claim 1, wherein the set of preferences indicates a reward payout structure for the at least one of the plurality of games.

6. The system according to claim 1, further comprising a user interface and wherein the controller is coupled to the user interface and is further configured to parse authorization data received via the user interface from the plurality of players.

7. The system according to claim 1, further comprising a user interface and wherein the controller is coupled to the user interface and is further configured to parse authorization data received via the user interface from a combination of a game broker and the plurality of players.

8. The system according to claim 1, wherein the controller is further configured to transmit an invitation via the network interface to each of the plurality of players, the invitation indicating the at least one of the plurality of games.

9. The system according to claim 1, further comprising a user interface and wherein the controller is coupled to the user interface and is further configured to parse authorization data received via the user interface from a game organizer.

10. The system according to claim 1, wherein the controller is further configured to parse prize data received via the network interface, the reward data indicating at least one reward.

11. The system according to claim 10, wherein the prize data indicates at least one sponsor who will provide the at least one reward and wherein the controller is further configured to:

parse advertisement information received via the network interface from the at least one sponsor; and transmit the advertisement information via the network interface to at least one of the plurality of players.

12. The system according to claim 10, wherein the prize data indicates at least one of the plurality of players who will provide the at least one reward.

13. The system according to claim 12, wherein the prize data includes an entry fee and the controller is further configured to generate deposit data for transmission via the network interface to a financial institution, the deposit data indicating a bank account.

14. The system according to claim 13, wherein the prize data includes an entry fee and the controller is further configured to generate deposit data for transmission via the network interface to a financial institution, the deposit data indicating an escrow account.

15. The system according to claim 1, wherein the controller is further configured to parse player data received via the network interface from at least one of the plurality of player information systems, the player data identifying the plurality of players.

16. The system according to claim 15, wherein the controller is further configured to generate qualification data for transmission via the network interface to the at least one of the plurality of player information systems, the qualification data indicating at least one criterion for entry into the at least one of the plurality of games.

17. The system according to claim 16, wherein the at least one criterion indicates that each of the plurality of players should be a member of a loyalty club.

18. The system according to claim 17, wherein the at least one criterion indicates that each of the plurality of players should have a specified level of skill.

19. The system according to claim 16, wherein the at least one criterion indicates that each of the plurality of players should be older than a specified age.

20. The system according to claim 16, wherein the at least one criterion indicates that each of the plurality of players should have an income greater than a specified level.

21. The system according to claim 1, wherein the controller is further configured to receive authorization from at least one of the plurality of players to reward the at least one winner.

22. The system according to claim 1, wherein the controller is further configured to allow at least one of the plurality of players to deny entry to a prospective player seeking to enter at least one of the plurality of games.

* * * * *